US006056137A

United States Patent [19]

Cannan, Jr. et al.

[11] Patent Number: 6,056,137

[45] Date of Patent: May 2, 2000

[54] RETROFIT UNDERGROUND STORAGE TANK AND METHOD FOR MAKING THE SAME

[75] Inventors: Edward B. Cannan, Jr., Conroe; Michael Blackmar, New Caney; Edgar Clifford Crosby, III, Conroe; Larry D. Lumpkin, Conroe; John C. King, Conroe; Stephen C. Macy, The Woodlands, all of Tex.

[73] Assignee: Fluid Containment, Inc., Conroe, Tex.

[21] Appl. No.: 08/508,215

[22] Filed: Jul. 27, 1995

[51] Int. Cl.[7] ..... A65D 85/00

[52] U.S. Cl. ..... 220/4.12; 220/62.11; 220/669; 220/674

[58] Field of Search ..... 220/470, 4.12, 220/62.11, 669, 674

[56] References Cited

U.S. PATENT DOCUMENTS

| | | | |
|---|---|---|---|
| 2,861,277 | 11/1958 | Hermann | 220/571 |
| 4,393,531 | 7/1983 | Hodel | 220/470 |
| 4,411,373 | 10/1983 | Kupersmit | 220/470 |
| 4,548,321 | 10/1985 | Mockesch et al. | 220/470 |
| 4,813,556 | 3/1989 | Lawrence | 220/470 |
| 4,941,589 | 7/1990 | Chen | 220/470 |
| 5,054,635 | 10/1991 | Kolom | 220/4.15 |
| 5,421,479 | 6/1995 | Noorafshani | 220/571 |

*Primary Examiner*—Joseph M. Moy
*Attorney, Agent, or Firm*—Crowell & Moring LLP

[57] ABSTRACT

The present invention is directed to a retrofit underground storage tank (30) and method for making the same. A portion of an underground primary tank (32) its uncovered and an access opening (42) in formed therein. A plurality of trifolds (50, 120, 122, and 124) comprising three folded up and banded together panels (52, 54, 56) which are jointed together by hinges are inserted into the primary tank. A monorail or conveyor (90) is inserted into and suspended from above the primary tank (32). Trolleys (102, 104) on the monorail (90) assist in transporting the trifolds (50, 120, 122 and 124) within the primary tank (32) and then the monorail (90) is removed. Trifolds (50, 120, 122 and 124) are unbanded and unfolded and are arranged circumferentially about the tank. Jack stands are used to hold panels of the trifolds in place. Circumferential and longitudinal joints are formed between abutting edges on the panels using fiberglass reinforced plastic mats, woven rovings and resins layups thus creating an inner cylindrical wall (230) within primary tank (32). Further panels are joined together to form a pair of end caps (260, 300) which are jointed to inner cylindrical wall (330) thus creating an inner tank (312). The access opening (42) in primary tank (32) is then covered with a panel which is sealed to primary tank (32). The inner tank and outer primary tank (32) cooperate to form a retrofit double walled storage tank (30). Brine, pressure, vacuum, or a dry monitor are installed between the inner and outer tanks to allow monitoring of the tank.

6 Claims, 8 Drawing Sheets

RETROFIT UNDERGROUND STORAGE TANK AND METHOD FOR MAKING THE SAME

TECHNICAL FIELD

This invention relates generally to underground storage tanks, and more particularly, to the retrofitting of storage tanks by placing a secondary liner within a primary underground tank.

BACKGROUND OF THE INVENTION

Some underground storage tanks can corrode (i.e. bare steel) and poorly installed tanks may leak over time. When this occurs, the tank must be replaced or repaired. The removal and replacement of underground storage tanks are very expensive as this often requires the remediation of soil around the leaking tank. There are also instances, where for environmental or liability reasons, the tank owner may choose to upgrade tanks to secondarily contained tanks. Replacement is expensive.

Several suggestions have been made as how to retrofit or upgrade tanks using a secondary container or liner. For example, U.S. Pat. No. 5,261,764 to Walles, discloses installing at least one plastic coating within an existing tank to form a resultant double walled tank. Trussler, U.S. Pat. Nos. 5,060,817 and 5,102,005 provide external containment capsules which surround existing underground storage tanks. Jones, U.S. Pat. No. 3,167,209, teaches providing a flexible tank liner within an outer rigid tank. Other repairs methods include simply applying a coating of polyester or epoxy to the inside of a tank.

However, each of the methods has drawbacks for example, simply applying a coating of material on the inside of a tank produces a secondary tank or container which has little independent structural strength apart from the surrounding outer tank. In the event the outer tank corrodes or otherwise degrades sufficiently so that the outer tank cannot withstand the internal or external forces on the outer tank, it is desirable that the inner secondary tank have significant strength of its own. Further, providing a structurally sound inner tank allows for pressure monitoring of the annulus space created between the tanks using air or liquid as the annular space monitoring medium.

Placing a secondary containment vessel about the outside of an underground outer tank requires that all of the outer tank be exposed. This complete exposure of the tank from a covering layer of soil requires a great deal of work and expense.

The present invention has been developed to overcome the above cited deficiencies by providing a secondary or inner tank within a primary or outer tank. The secondary tank has significant self support or rigidity and requires a minimal amount of work to install within the outer tank.

SUMMARY OF THE INVENTION

A method for retrofitting an underground primary storage tank located beneath a covering layer is disclosed. The method comprises the following steps. A portion of an underground primary tank is uncovered from a covering layer. An access opening is cut in the primary tank. A plurality of rigid prefabricated panels are inserted into the primary tank through the access opening. The panels are arranged about the surface of the primary tank with edges of the panels adjacent one another. The adjacent edges of the panels are laid up with fiberglass reinforced plastic mats and resins to form joints between the panels. The resins in the joints are allowed to cure creating a fluid tight inner tank within the primary tank.

Preferably, the panels include an arcuate rectangular segment and at least one reinforcing rib secured thereto. Ideally, the insertion of the plurality of rigid panels includes securing at least two panels together prior to their insertion so that the at least two panels are inserted through the access opening at the same time. The panels may be secured together by one or more hinges to form a trifold.

The method may also include laying up the ribs on the panels to form a circumferentially continuous integral reinforcing hoop extending 360 degrees about the tank. Jack stands may be used to hold the panels flush against the inner surface of the primary tank during the forming of joints between the panels.

The method may optionally include using a conveyor system within the primary tank to transport the panels within the primary tank. Also optionally, a monitoring system can be installed into the space between the inner tank and the outer tank to fluidly monitor the space created therebetween by the formation of the inner tank within the outer tank.

An insert for use in retrofitting a storage tank is also described. The insert comprises first and second arcuate fiberglass panels and at least one hinge connecting the first panel to the second panel. The panels can be folded together to form a compact configuration and can be unfolded to form a larger combined arcuate surface.

A retrofit tank is also provided comprising an outer primary tank, a plurality of discrete arcuate fiberglass panels arranged within the outer primary tank to line the outer primary tank, and a plurality of layup joints affixing the arcuate panels together. The layup joints and arcuate panels cooperate to form a fluid tight inner tank within the outer primary tank. A monitoring apparatus may be disposed between the inner tank and the outer tank to monitor the leakage of fluid in the space located between the inner and outer tanks.

It is an object of the present invention to provide a secondary or inner tank within a preexisting primary underground tank to create a retrofitted storage tank wherein the secondary tank has significant self support apart from the primary tank.

A further object is to provide a plurality of hinged panels which are folded together for insertion into an access opening in a primary tank and are then unfolded to cover significant portions of the inner periphery of the primary tank whereby the panels can be joined together using a minimal number of joints thus saving assembly time and expense.

Still an additional object is to construct a tank within a tank to form a tank with an annular space defined therebetween which can be manually or electronically monitored for leakage.

BRIEF DESCRIPTION OF THE DRAWINGS

These and other features, objects, and advantages of the present invention will become readily apparent from the following description, pending claims, and accompanying sheets of drawings where:

BEST MODES FOR CARRYING OUT THE INVENTION

Figure 12:
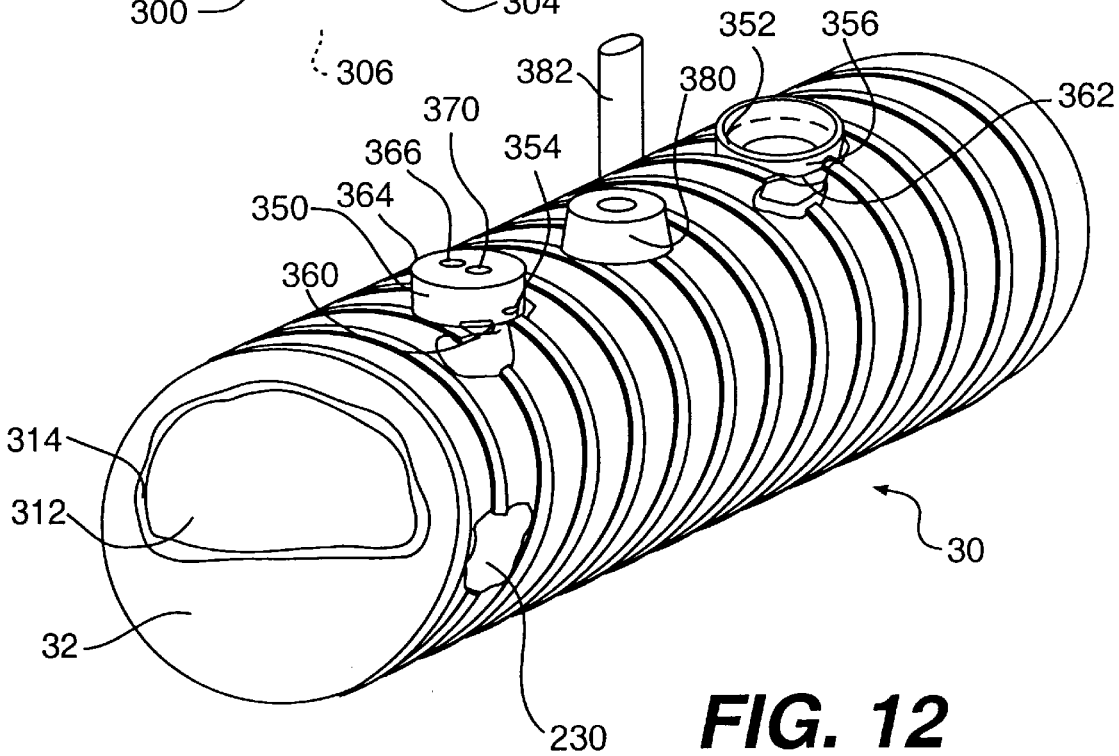
FIG. 12 is a perspective of the retrofitted storage tank of the first embodiment which includes the outer primary tank and the inner secondary tank.

The present invention is directed toward retrofit underground storage tanks 30 and 30' and methods for making the same. Retrofit tank 30 is shown in FIG. 12 in its completed state. In a first embodiment, a plurality of discrete trifolds of panels and end panels are inserted into a primary tank 32 and are joined together to form a fluid tight inner tank. These retrofit tanks 30 and 30' and methods for making the same will now be described in more detail.

Figure 1:
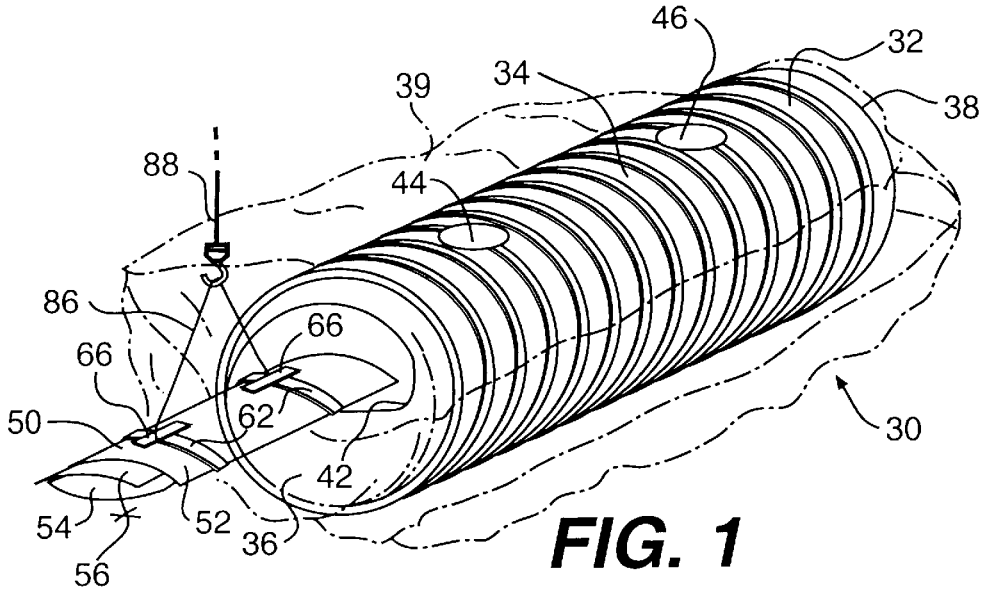
FIG. 1 is a perspective view of a trifold of panels being inserted into a primary tank which is to be retrofitted into the single walled storage tank in accordance with a first embodiment of the present invention.

FIG. 1 illustrates a primary tank 32 which is to be retrofitted, in accordance with the present invention, into retrofit tank 30. Primary tank 32 has a cylindrical wall 34 and a pair of longitudinally spaced apart domed rear and forward end caps 36 and 38. Tank 32 is shown with a plurality of circumferentially extending support ribs on its external surface. In this exemplary first embodiment, the diameter of tank 32 is 8 feet and its length is 30 feet, with a capacity of 10,000 gallons. Of course, this method of retrofitting tanks applies to tanks of various other sizes as well. The primary tank can also have flat end caps and no circumferential external support ribs as is common with steel tanks.

First, preexisting underground primary tank 32 is at least partially uncovered from surrounding soil 39. The top surface of cylindrical wall 34 and at least one end, such as end cap 36, are exposed. A large access opening 42 is cut into the upper half of end cap 36. Likewise, unless they previously exist, a pair of longitudinally spaced apart top openings 44 and 46 are cut into cylindrical wall 34. Access opening 42 is sufficiently large to receive end cap panels, which are joined together to form an inner end cap 48, and trifolds of rectangular, arcuate panels therethrough. Top openings 44 and 46 are sized to easily allow a work person to pass therethrough to access the interior of primary tank 32.

Figure 2:
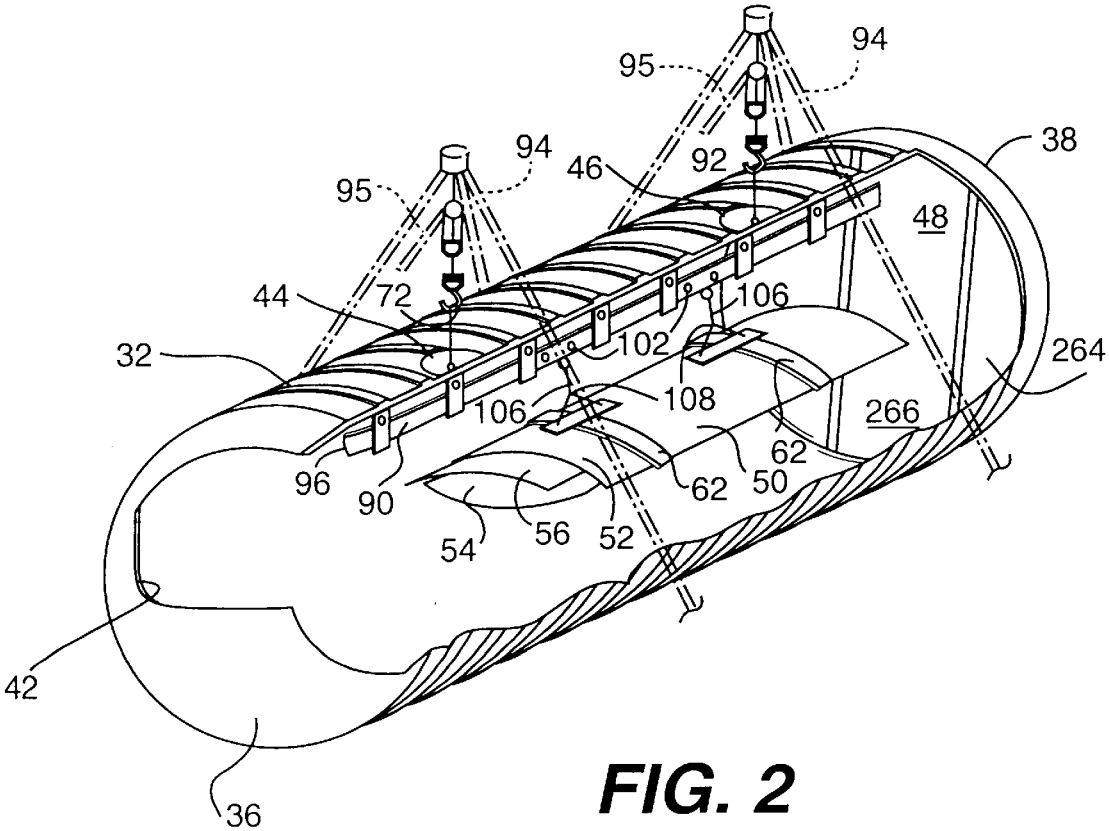
FIG. 2 is a perspective view, partially in cutaway, of the trifold being transported within the primary tank on a monorail.

End cap 48 is shown in FIGS. 2 and 12. End cap 48 may be laid up either before or after the remainder of the inner tank is installed, although preferably before. Details regarding end cap 48 will described later.

Figure 13:
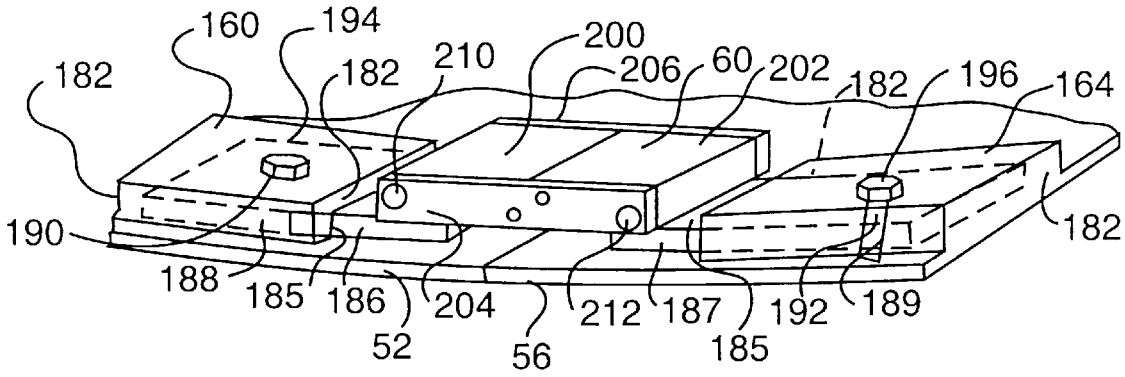
FIG. 13 is a view of an exemplary hinge used to join adjacent panels together in forming a trifold.

A first trifold 50 is one of four such trifolds used in this exemplary embodiment. With a smaller tank possibly only two trifolds would be required. With larger, longer tanks more trifolds may be required. Trifold 50 comprises a pair of lateral panels 52 and 54 joined to a center panel 56 using four hinges 60, which are not shown in FIG. 1. An individual hinge 60 is illustrated in FIG. 13. Trifold 50 is shown in greater detail in FIG. 5 and will be also described in greater detail later as will be hinge 60. A pair of longitudinally spaced apart bands 62 are strapped about the periphery of trifold 50 to maintain panels 52, 54 and 56 in a compact folded up state. Bands 62 are preferably made of steel.

Figure 15:
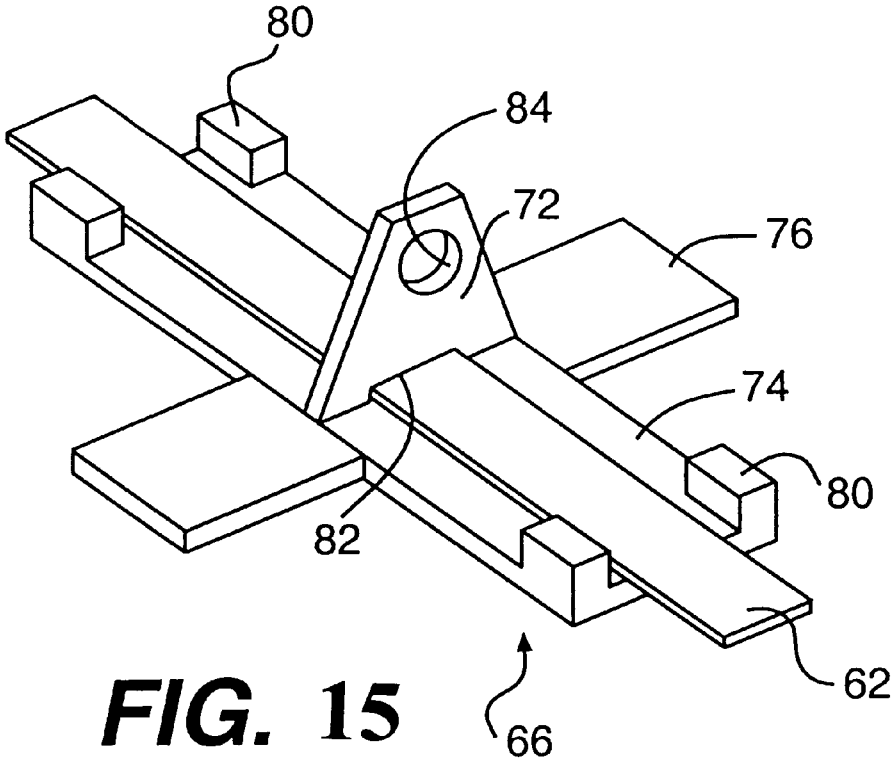
FIG. 15 is a perspective view of holder used to retain a strap which keeps a trifold folded up during transport of the trifold.

A pair of generally identical holders 66 are used in lifting and transporting trifold 50. As best seen in FIG. 15, a holder 66 has a triangular vertical web 72 attached to horizontally extending and crossing flat bare 74 and 76. Bar 74 extends circumferentially and has two pair of guide blocks 80 thereon for guiding one of straps 62. Bar 76 extends longitudinally. An opening 82 is formed in web 72 which allows strap 62 to circumferentially pass through web 72 along the top of bar 74 and between guide blocks 80. An eyelet 84 is located in the top of web 72 to receive a hook or device for lifting holder 66.

A monorail 90, shown in FIG. 2, is inserted through access opening 42 into primary tank 32 prior to inserting trifold 50. A pair of cables 92 are fed through top openings 44 and 46 suspending monorail 90 along the top of primary tank 32. Cables 92 are supported by respective tripods 94 and pulleys 95 located above primary tank 32. Monorail 90 has a hollow rectangular track 96 with a vertical slot located in the bottom thereof. A pair of trolleys 102 travel back and forth within track 96 and carry respective cables 106 having devises 108 thereon which are releasably attachable to eyelets 84 of holders 66 to longitudinally transport trifold 50.

Returning to FIG. 1, bands 62 hold trifold 50 in a folded, compact state. Holders 66 receive bands 62 through their web openings 82. The ends of bands 62 are secured together using clamps not shown. A support cable 86 with hooks or devises at either end thereof attaches to the eyelets 84. Cable 86 may be supported by cable 88 attached to a crane, a hoist, or a bucket of a backhoe or the like which is not shown, and is used to lift and horizontally transfer trifold 50 into access opening 42. Alternatively, rather than using cable 86, a single sling could be wrapped about the center of trifold 50 to support trifold 50 in a balanced manner. This sling could then be moved to transport trifold 50.

A first or forward end of trifold 50 is fed into access opening 42. Cable 86 is disconnected from the forward holder 66 and device 108 which is suspended from the forwardmost trolley 102. Cable 88 then may be directly attached to the rear holder 66. Trifold 56 is then fed further into primary tank 32 until the rear holder 66 is adjacent access opening 42. The second or rearwardmost device 108, suspended from the other trolley 102, is then attached to rearward holder 66 in place of cable 88.

Trifold 50 is conveyed on trolleys 102 adjacent to the forward end cap 38. Monorail 90 is then lowered by pulleys 95 from tripods 94 until first trifold 50 rests upon the floor of primary tank 32 adjacent forward end cap 38. Clevises 108 are detached from forward and rear holders 66 and monorail 90 is again raised adjacent the roof of primary tank 32.

Figure 3:
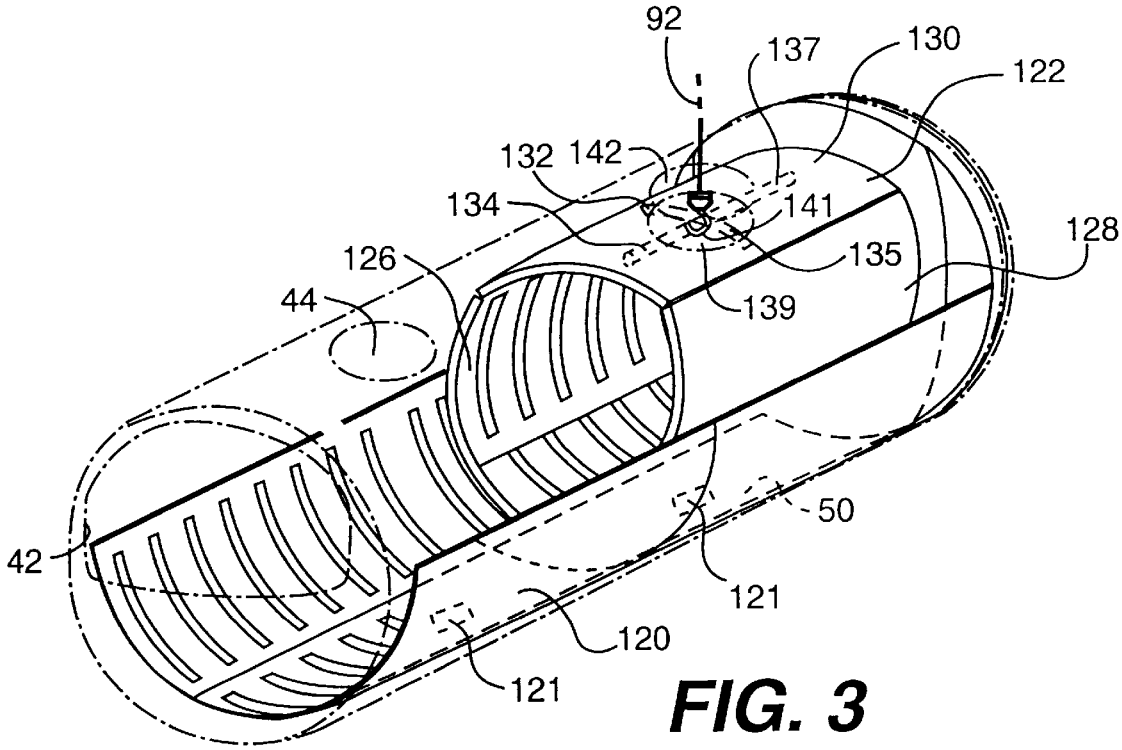
FIG. 3 is a perspective view, partially in cutaway, of a pair of trifolds lining the floor portion of the primary tank and another trifold being lifted against the roof of the primary tank.

Bands 62 are removed from trifold 50. Next, trifold 50 is unfolded with panels 52, 54, and 56 resting flushly upon the curved lower half or floor of primary tank 32. This trifold transporting process is repeated with a second trifold 120 being inserted into primary tank 32 in the manner just described. However, second trifold 120 is positioned adjacent rear end cap 36 on the floor of primary tank 32. Trifold 120 is unbanded and unfolded flushly covering the rear half of the floor of primary tank 32. Accordingly, unfolded trifolds 50 and 120 cover the lower half of inner cylindrical wall 34, as seen in FIG. 3. Each of trifolds 50 and 120 have a steel deflector plate 121, approximately 24"×24", which is encapsulated in plies of fiberglass and resin. Deflector plates 121 prevent dip rods, which measure depth of fluid in the tank, from passing through the fiberglass panels.

A third trifold 122 is next transferred into primary tank 32 in a similar manner as trifold 50 and 120. Trifold 122 is placed atop first trifold 50. Finally, a fourth trifold 124 is placed into primary tank 32 and placed upon second trifold 120 adjacent rear end cap 36. Trifolds 122 and 124 are then unbanded. As monorail 90 is no longer needed, monorail 90 is removed from primary tank 32 through access opening 42.

Each of trifolds 122 and 124 have respective lateral panels 126 and 128 and a center panel 130 with a circular opening 132 formed therein. Centering lifting devices 134 are placed into respective openings 132 of trifold 122 and 124 to lift these trifolds. Centering lifting device 134 may be placed into openings 132 either before or after trifolds 122 and 124 have been placed inside primary tank 32.

Figure 16:
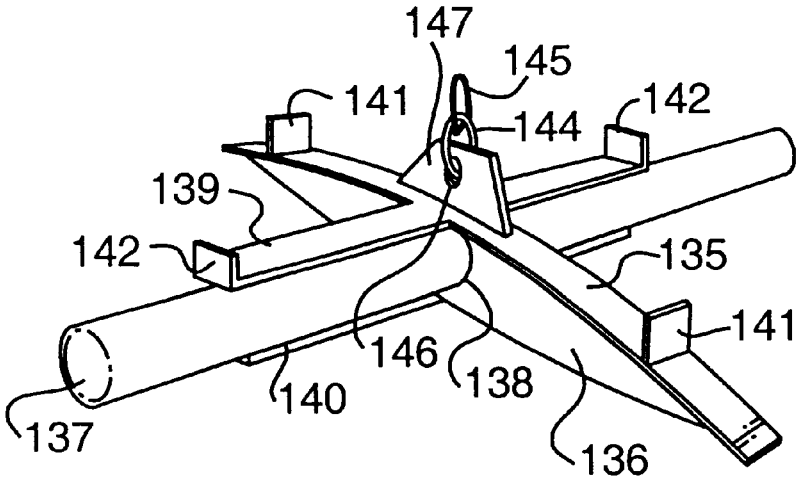
FIG. 16 is a perspective view of a lifting device used to suspend a trifold against the roof of the primary tank.

An individual lifting device 134 is beat seen in FIG. 16. Lifting device 134 includes an upper arcuate plate 135 and a support web 136 which welded beneath arcuate plate 135. A pipe 137 extends longitudinally through an opening 138 in support web 136. Sandwiching above and below pipe 137 are longitudinally extending beams 139 and 140. Arcuate beam 135 and transverse beam 139 have respective locating prongs 141 and 142 which are sized to snugly cooperate with opening 132 of trifolds 122 and 124. A pair of devises 144 and 145 secure to an eyelet 146 in a web plate 147 welded atop arcuate plate 135.

As shown in FIG. 3, a center panel 130 rests upon upper arcuate plate 135 and transverse beam 139. Prongs 141 and 142 keep the respective trifold centered and balanced upon lifting device 134.

A cable 92 is lowered through a respective opening 132 in trifold 122 and is attached to respective lifting device 134. Cable 92 is then raised lifting panel 130 of trifold 122 against the roof of primary tank 32. Opening 132 in trifold 122 is generally coaxially aligned with top opening 46. In a similar manner, trifold 124 is located beneath the inner upper surface of primary tank 32.

Figure 4:
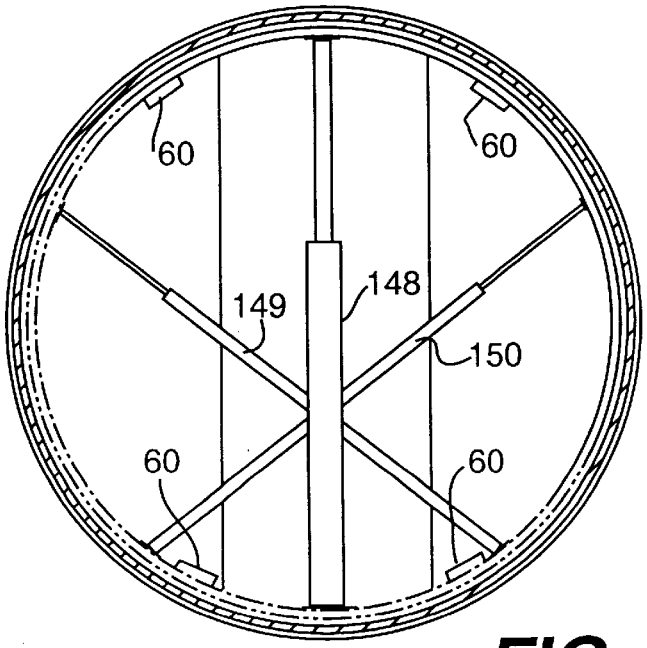
FIG. 4 is an end view showing jack stands holding individual panels of trifolds flushly against the interior of the primary tank.

A series of longitudinally spaced extensible jack stands 148, 149 and 150, as shown in FIG. 4, are used to hold trifolds 122 and 124 in place flush against the upper half of primary tank 32. With a sufficient number of jack stands in place, lifting devices 134 are no longer needed to suspend trifolds 122 and 124. Consequently, lifting devices 134 may be removed from primary tank 32.

Figure 5:
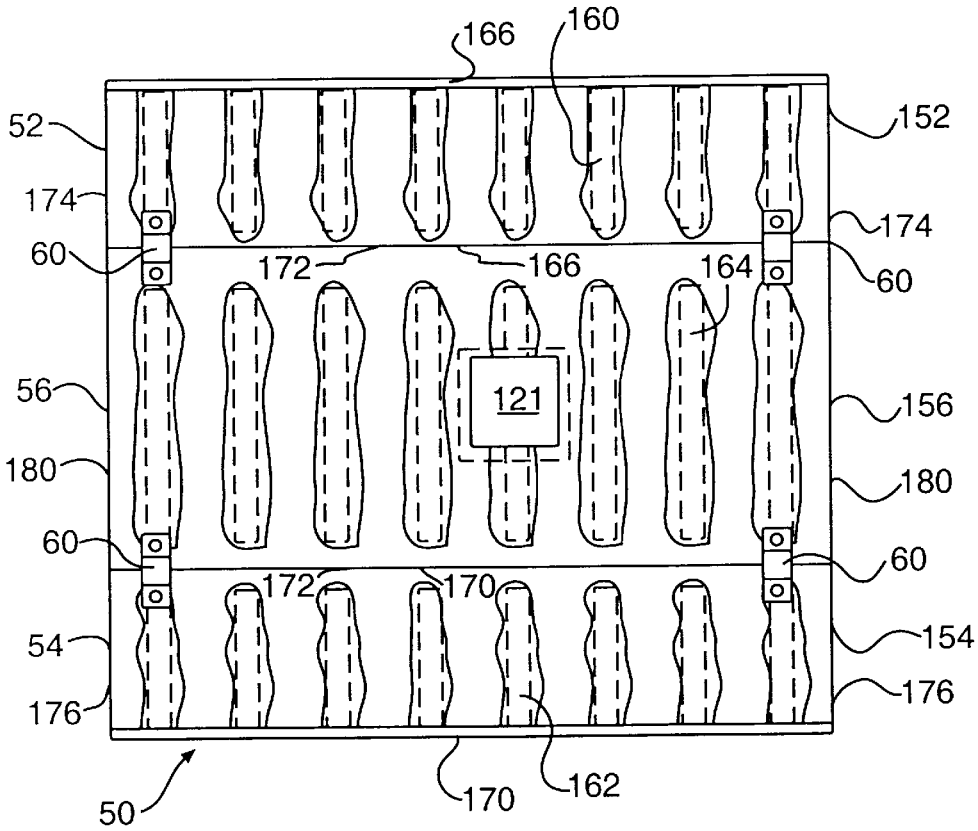
FIG. 5 is a top view of an unfolded trifold.

A plan view of unfolded trifold 50 is shown in detail in FIG. 5. Trifolds 120, 122 and 124 are generally identical with trifold 50 with the exception that trifolds 122 and 124 have openings 132 in their center panels. Also, trifolds 50 and 120 have deflector plates 121 which are designed to be located directly under corresponding openings 132 when all trifolds are installed. Panels 52, 54 and 56 have respective arcuate rectangular segments 152, 154 and 156 with integrally attached ribs 160, 162 and 164. Segments 152, 154 and 156 have respective parallel pairs of longitudinally extending edges 166, 170 and 172 and pairs of parallel circumferentially extending ends 174, 176 and 180. Each of panels 52, 54 and 56 have a circumferential arc length of approximately 60 degrees.

Each of ribs 160, 162 and 164 terminate approximately 5 inches from the longitudinal edges 166, 170, and 172 of their respective panels 52, 54, and 56. An exception is on center panels 56 which have deflector plates 121. There, ribs 164 terminates at the edge of the deflector plate layups. Ribs 160, 162 and 164 each include elongate plastic forms 182 which are hollow and are generally trapezoidal in shape. The base of the trapezoid lies adjacent the arcuate segments having a width of approximately 5 inches and top being approximately 4 inches with an overall form height of approximately 1 inch. Plastic forms 182 are attached to panels 52, 54 and 56 using fiberglass reinforced plastic mats and woven roving and polyester resins to form layups 184 as is conventional in the art of fiberglass reinforced plastic tank construction. The forms can also be attached using layups of fiberglass mat and an appropriate resin. Examples of such resins include isophthalic polyester and other polyester, vinyl ester, and epoxy resins, or other resin systems.

To construct each panel, a complete cylindrical wall may first be made and then the separate arcuate segments 152, 154 or 156 of each of the trifolds are cut therefrom. Alternatively, arcuate male or female molds or mandrels may be used to form each of the individual arcuate segments 152, 154, or 156. Preferably, the arcuate panel segments 152, 154, or 156, have an arcuate length between 30 degrees and 90 degrees or an arcuate length between 45 degrees and 75 degrees. After segments 152, 154, and 156 have been made, ribs 160, 162 and 164 are added thereto using the forms 182 and the overlying layups 184. It is much easier to lay up the ribs 160, 162 and 164 during construction of panels 52, 54 and 56 at a manufacturing facility as compared to installing the ribs within primary tank 32 at the job site.

Two pairs of hinges 60 are used to secure panels 52, 54 and 56 together. An exemplary hinge 60 attaching to a pair of ribs 160 and 164 is shown in FIG. 13. A pair of circumferentially spaced curved plates 186 and 187 which generally match the curvature of panels 52, 54, and 56, extend into rectangular openings 185 formed in hollow plastic forms 182 of ribs 160 and 164. Each of plates 186 and 187 has a respective tapped hole 188 and 189 therein. Apertures 190 and 192 are created in ribs 160 and 164. Bolts 194 and 196 are inserted through apertures 190 and 192 in ribs 160 and 164 and are threadedly received in tapped holes 188 and 189 in plates 186 and 187 to secure hinge 60 to panels 52 and 56.

Welded to the inboard ends of plates 186 and 187 are blocks 200 and 202. Blocks 200 and 202 are laterally sandwiched by a pair of longitudinally spaced plates 204 and 206. Hinge pins 210 and 212 pass through respective blocks 200 and 202 and sandwiching plates 204 and 206. Consequently, block 202, associated plate 187 and panel 56 can fold relative to panel 52. In a similar fashion, all the panels of trifolds 50, 120, 122 and 126 can be folded with respect to other panels in their corresponding trifold to be placed into a compact folded configuration for insertion into access opening 42.

Figure 6:
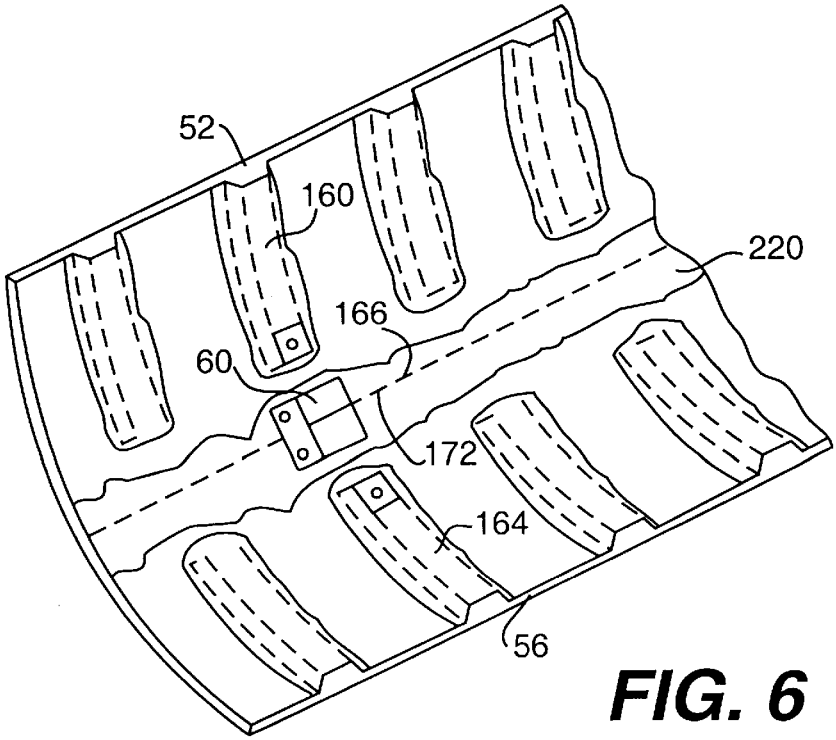
FIG. 6 is a fragmentary perspective view of a discontinuous longitudinal joint, including a hinge, formed between adjacent panels of a trifold.

All gaps between edges of adjacent panels are filled with a fiberglass reinforced polyester "putty", such as Cabosil polyester resin mixture with milled fibers, and are allowed to harden. FIG. 6 shows a panel 52 attached to a panel 56. Longitudinally extending edges 166 and 172 of panels 52 and 56 abut one another. After the FRP putty hardens a portion of a longitudinal joint 220 is formed by placing an elongate 3-ply "hot patch" or other number of plies of layups 222 across the top of abutting edges 166 and 172, except where hinge 60 connects panels 52 and 56 together. This process is repeated with other intermittent longitudinal joints 220 being formed between abutting longitudinal edges of the panels of trifolds 50, 120, 122 and 126.

Figure 7:
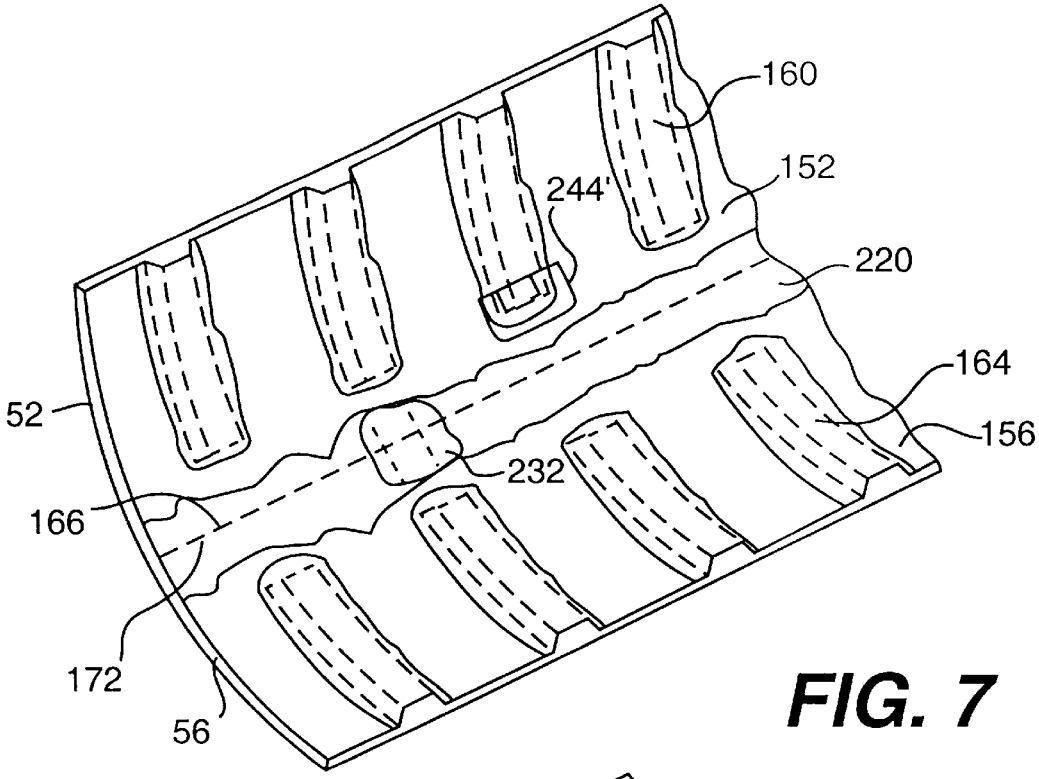
FIG. 7 is a fragmentary perspective view of the completed longitudinal joint of FIG. 6 with the hinge removed.

Looking to FIG. 7, once the 3-ply "hot patch" or other number of plies layups 222 have cured, hinges 60 are removed from trifolds 50, 120, 122, and 124. Patches of layups 232 are applied to each of the longitudinal gaps in longitudinal joints 220 where hinges 60 had previously been disposed. Six longitudinal joints 220 therefore now continuously run the length of trifolds 50, 120, 122, and 124 forming a continuous inner cylindrical wall 230.

Figure 9:
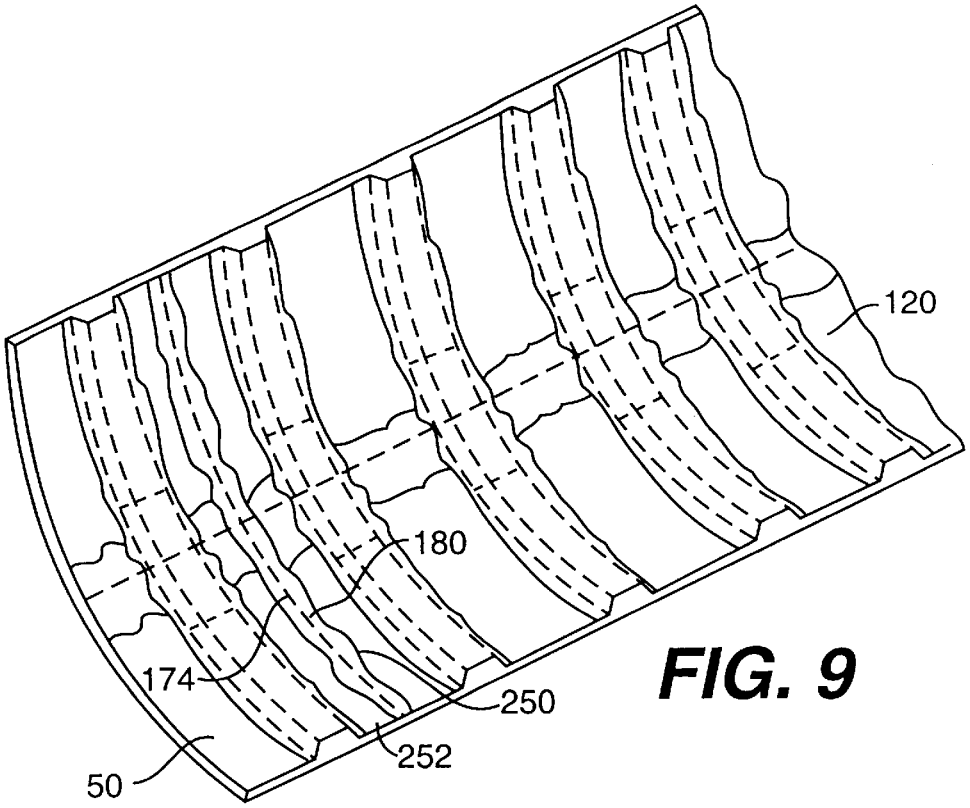
FIG. 9 is a fragmentary perspective view of a pair of longitudinally spaced panels being joined at their ends by a circumferential joint.

Next, circumferentially extending joints are formed between panels. FIG. 9 shows an exemplary circumferentially continuous joint 250 formed by applying 3-ply "hot patch" or other number of plies of layups 252 over abutting circumferentially extending edges such as edges 174 and 180. Edges 174 and 180 are found on longitudinally disposed trifolds 50 and 120. All of the panels of trifolds 50, 152, 154, and 156 are similarly circumferentially joined. Consequently, both circumferentially and longitudinally extending joints of layups connect the various panels of the trifolds together.

After all "hot patch" layups are cured, all of the jack stands 148, 149, and 150 are removed. Layups of alternating fiberglass mat/woven roving and appropriate resins are then applied on all longitudinal joints 220 and all circumferential continuous joints 250. Also, layups of fiberglass mat and polyester resin may be used to form joints 220 and 250.

Figure 8:
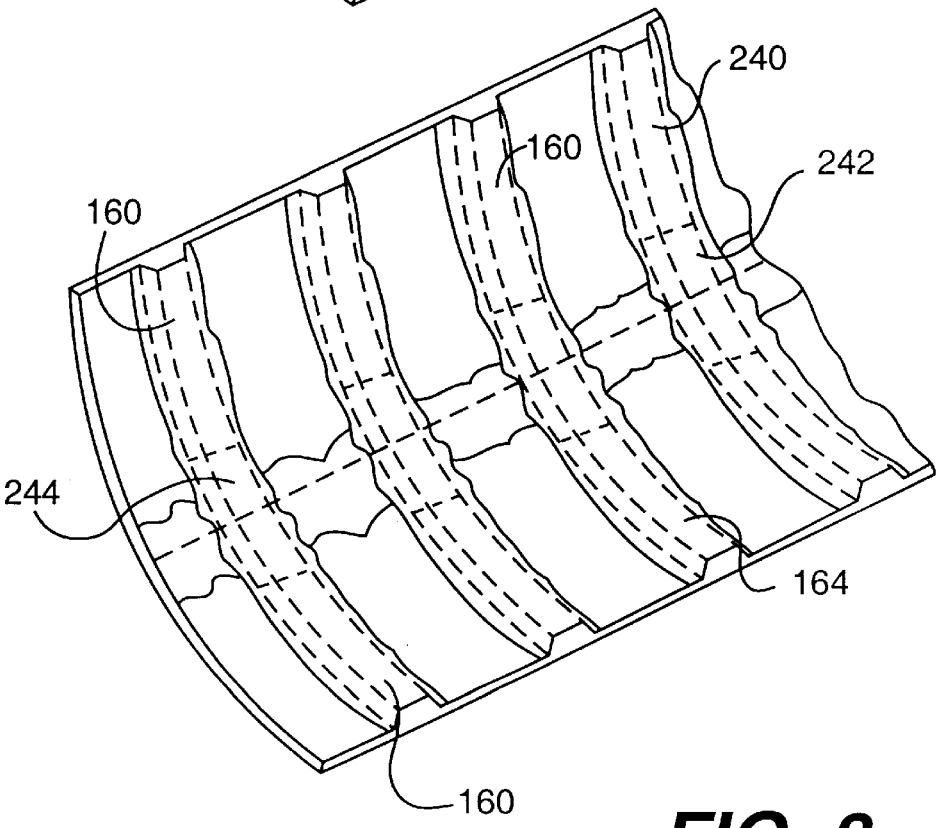
FIG. 8 is a fragmentary perspective view of rib portions laid up with ribs on adjacent panels.

FIG. 8 illustrates the circumferential joining of ribs 160 and 164. Inserted in the circumferential gap between the ends of each of ribs 160 and 164 is a rib portion 242. Rib portions 242 are made of the same material as forms 182 which were attached to segments 152, 154 and 156 during the fabrication of panels 50, 120, 122 and 124. 5-ply or other number of plies of layups of alternating mat/woven roving 244 are applied over adjoining ribs portions 242 and ribs 160 and 164. This process of laying up ribs and rib portions 242 is continued until longitudinally spaced circumferentially continuous integral reinforcing hoops 240 of ribs and rib portions are formed throughout tank 32 The ribs forming the longitudinally spaced hoops 240 are 16½ inches on center in this exemplary inner wall 230. Preferably, reinforcing hoops 240 range between 10 inches and 36 inches on center, depending, of course, on the size of the particular primary tank to be retrofitted. In an alternative embodiment, in place of rib portions 242 and layups 244, layups of 21 plies, or other substantial number of plies, may be placed circumferentially between ribs 160 and 164.

Figure 10:
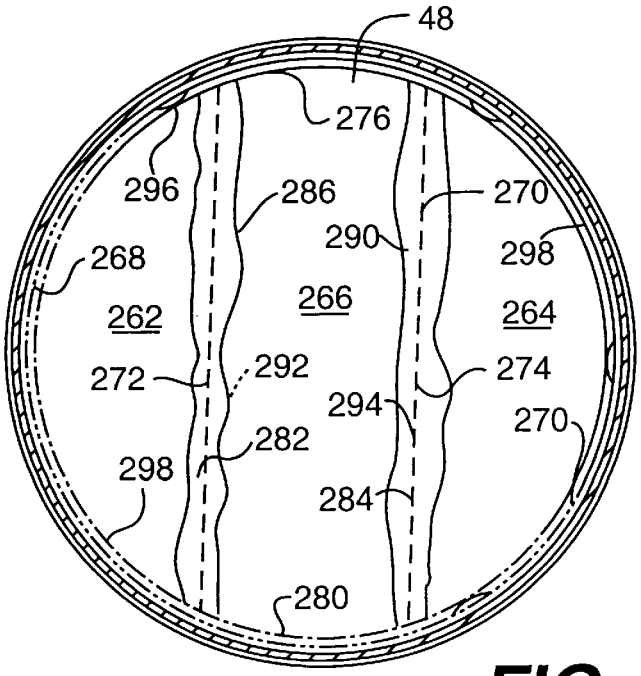
FIG. 10 is a sectional view showing a first end cap laid up within an end cap of the primary tank.

FIG. 10 shows end cap 48 in greater detail. End cap 48 locates against end cap 38 of primary tank 32. End cap 48 can be installed prior to the insertion of the trifolds or else after the panels of the trifolds have been bonded together to form inner cylindrical wall 230.

End cap 48 may be dome-shaped, dish-shaped or flat, and includes lateral panels 262 and 264 sandwiching about a center panel 266. Panels 262, 264 and 266 are sufficiently lightweight that they can be moved manually and placed within primary tank 32 without the use of monorail 90. Panels 262, 264 and 266 are placed against end cap 38 and abut one another as shown in FIG. 10. Lateral panels 262 and 264 have respective circumferential edges 268 and 270 and vertical edges 272 and 274. Center panel 266 has a pair of spaced apart lower and upper circumferential edges 276 and 280 and a pair of vertical edges 282 and 284. Jack stands may be used to hold there panels in place prior to their being laid up together.

3-ply "hot patch" layups 286 and 290 are placed over abutting vertical edges 272 and 282 and over edges 274 and 284 to form a pair of vertical joints 292 and 294. Circumferential edges 266, 280, 270 and 276 are secured to abutting circumferentially extending edges 166, 172, and 170 of trifolds 50 and 120 using 3-ply "hot patch" layups 296 to form a circumferentially continuous joint 298 sealingly joining domed end cap 260 to inner cylindrical wall 230. After the layups have cured, jack stands are removed. Then, a 10 ply, or other number of plies is placed over layups 286, 290 and 296.

Figure 11:
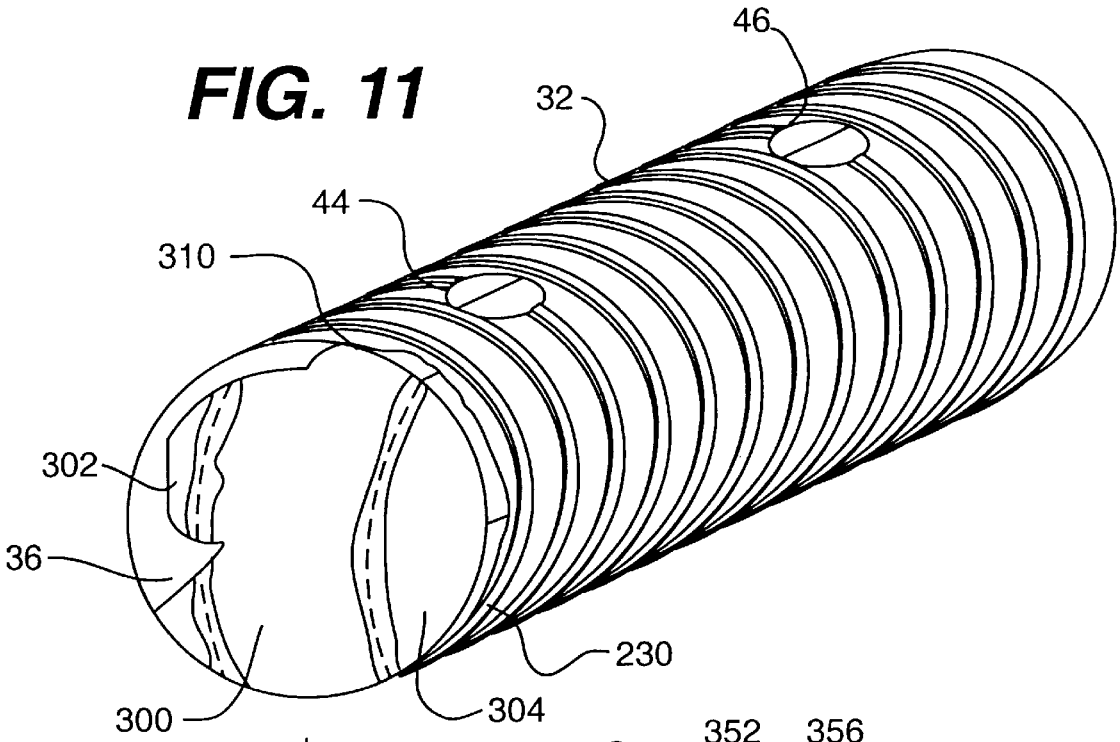
FIG. 11 is a perspective view, partially cutaway, of a second end cap laid up inside the other end cap of the primary tank.

Referring now to FIG. 11, an end cap 300 similar to end cap 260, is added to inner wall 230 adjacent rear end cap 36 of primary tank 32. End cap 300 comprises panels 302, 304 and 306 which are joined to each other and to inner wall 230 using layups. These layups are applied on the inside of end cap 300. Inner cylindrical wall 230 and end caps 260 and 300 cooperate to form a fluid tight inner tank 310. As shown in FIG. 12, a panel 312 of fiberglass reinforced plastic is used to cover access opening 42 in primary tank 32. Layups 314, applied on the exterior of primary tank 320, are used to secure panel 312 over access opening 42.

Finally, a pair of man ways 330 and 352 are added to complete retrofit tank 30. Layups 354 and 356 are used to secure man ways 350 and 352 to top openings 44 and 46 in primary tank 32. Likewise, layups 360 and 362 are used to secure man ways 350 and 352 to openings 132 in inner tank 312. Cover 364 is used to close off manhole 350. Openings 366 and 370 are provided in cover 364 to accommodate the filling and emptying of inner tank 310.

Figure 14:
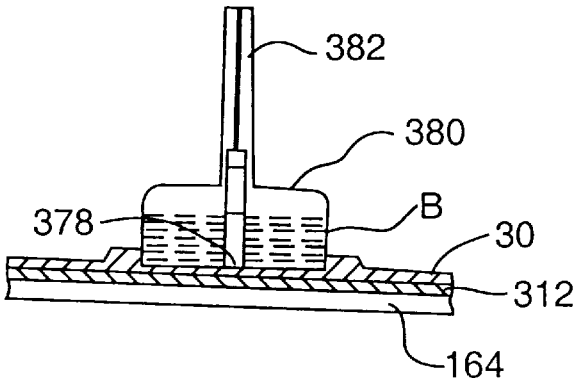
FIG. 14 is a fragmentary sectional view showing fluid integrity testing using a brine solution.

Provisions may be made for the monitoring of fluid leakage from either inner tank 312 or outer tank 32. Looking to FIG. 14, a 4", diameter hole 378 is drilled in the top of original tank 32. A fiberglass reservoir 380 is placed concentrically over this hole and fiberglass resin reinforcements are placed around reservoir 380 to seal it to the outside of tank 32. In the center of the reservoir is a preinstalled 4" diameter fitting which threadedly receives a 4" diameter, 4' high standpipe 382.

Stand pipe 382 is in fluid communication with the annular space between inner tank 312 and primary tank 32. A liquid dyed brine B is gravity-filled into standpipe 382 until liquid stops dropping in pipe. When the liquid level is 1 to 2 feet above tank 30, and drops no more than ¼ inch in one quarter hour, the tank is considered brine-filled. Retrofit tank 30 is then entered through one of the manways 350 or 352. The interior of inner tank 312 in inspected for any signs of the dyed brine leaking through joints of inner tank 312. Any such leaking joints are then remanufactured.

In lieu of brine, a dry sensor may be installed in the tank. In this embodiment, a U-shaped channel of 3 ply thickness, which extends within the circumference of the inner tank, is installed over the center joint. The channel can be made by placing a trapezoidal form, such as was used with the ribs, about a mandrel and applying 3 plies of material to create a 360 degree channel. A cut is made in the channel and the form and channel are removed from the mandrel. The form is ripped free of overlying channel leaving the channel with the U-shaped configuration.

The channel is placed within the outer tank 32 with a drawstring located therein. Then circumferential layup 230 is placed over the channel. The channel cooperates with the panels of the trifolds to form a hollow, 360 degree, annular conduit. A hole is cut in the panels beneath hole 378 in outer tank 32 to provide access to the drawstring. The drawstring is used to pull the dry probe into place inside tank 30' to provide for monitoring of the tank. Conventional electronic apparatus can be attached to the dry probe provided for monitoring. Pressure monitors, where positive or negative air pressure are employed to monitor the annular space, may also be used. This invention contemplates that other leak sensing means could also be employed to monitor the annular space.

While in the foregoing specification this invention has been described in relation to a certain preferred embodiment thereof, and many details have been set forth for the purpose of illustration, it will be apparent to those skilled in the art that the invention is susceptible to alteration and that certain other details described herein can vary considerably without departing from the basic principles of the invention.

For example, the inner tank could be constructed using discrete panels rather than using the trifolds with hinges connecting panels together. Also, the tank could be constructed without ribs. Rather, layups could be applied to the arcuate rectangular segments throughout the tank to replace the ribs having trapezoidal shaped forms with prefabricated layups which were constructed off-site from the retrofit operation.

What is claimed is:

1. A fiberglass reinforced tank insert for use in retrofitting an existing underground storage tank with secondary containment, the tank insert comprising:

(a) at least two arcuate panels constructed of fiberglass reinforced plastic and resin material;

(b) at least one hinge connecting the at least two panels along longitudinally adjacent edges such that:

(i) the at least two panels can be folded together at the hinged connection to form a compact configuration and can be unfolded to form a large combined arcuate surface, (ii) the at least two arcuate panels form a cylindrical shell when unfolded, (iii) the cylindrical shell has a diameter such that the cylindrical shell fits inside of the underground storage tank, and (iv) the longitudinally adjacent edges of the two panels are sealed with fiberglass reinforced plastic and resin material; and (c) at least one end cap capping each end of the cylindrical shell bonded and sealed thereto with fiberglass reinforced plastic and resin material.

2. The tank insert of claim 1 wherein the at least two arcuate panels each include at least one circumferentially disposed rib.

3. The tank insert of claim 1, wherein the at least two arcuate panels each have an arcuate length between about 30 degrees and about 90 degrees.

4. The tank insert of claim 1, wherein the at least two arcuate panels each have an arcuate length between about 45 degrees and about 75 degrees.

5. The tank insert of claim 2, wherein the at least one circumferentially disposed rib on the at least two arcuate panels is linearly aligned across the connected arcuate panels.

6. An insertable inner tank for use in retrofitting an underground storage tank thereby providing additional fluid containment, the insertable inner tank comprising:

a. at least two arcuate panels having structural rigidity;

b. at least one hinge connecting the at least two arcuate panels along longitudinal adjacent edges wherein the at least two panels:

i. can be folded together at the hinged connection to form a compact configuration fitting longitudinally inside the underground storage tank; and ii. when unfolded within the underground storage tank forms a cylindrical shell;

c. at least one end cap attached to each end of the cylindrical shell;

d. at least one sealable manway in one of the at least two arcuate panels;

e. fiberglass reinforced plastic sealant sealing the joints between the at least two arcuate panels and the joints between the end caps and the cylindrical shell forming a fully sealable inner tank.

* * * * *